US006481386B2

(12) United States Patent
Wittchow

(10) Patent No.: US 6,481,386 B2
(45) Date of Patent: Nov. 19, 2002

(54) FOSSIL-FIRED CONTINUOUS-FLOW STEAM GENERATOR

(75) Inventor: Eberhard Wittchow, Erlangen (DE)

(73) Assignee: Siemens Aktiengellschaft, Munich (DE)

( * ) Notice: Subject to any disclaimer, the term of this patent is extended or adjusted under 35 U.S.C. 154(b) by 0 days.

(21) Appl. No.: 09/951,822

(22) Filed: Sep. 13, 2001

(65) Prior Publication Data

US 2002/0017251 A1 Feb. 14, 2002

Related U.S. Application Data

(63) Continuation of application No. PCT/DE00/00864, filed on Mar. 20, 2000.

(30) Foreign Application Priority Data

Mar. 31, 1999 (DE) ..... 199 14 761

(51) Int. Cl.[7] ..... F22B 33/04

(52) U.S. Cl. ..... 122/6 A; 122/1 B; 122/406.4

(58) Field of Search ..... 122/1 B, 1 C, 122/4 D, 6 A, 406.4, 406.3, 451.5, 459, 460

(56) References Cited

U.S. PATENT DOCUMENTS

| | | | | |
|---|---|---|---|---|
| 3,043,279 A | | 7/1962 | Blomquist et al. | |
| 3,527,261 A | | 9/1970 | Bigler et al. | |
| 3,927,646 A | * | 12/1975 | Dungey et al. | 122/406.4 |
| 4,075,979 A | * | 2/1978 | Michel | 122/406.4 |
| 4,465,021 A | * | 8/1984 | Richter et al. | 122/4 D |

FOREIGN PATENT DOCUMENTS

| | | |
|---|---|---|
| DE | 1 987 132 | 6/1968 |

* cited by examiner

*Primary Examiner*—Gregory Wilson
(74) *Attorney, Agent, or Firm*—Laurence A. Greenberg; Werner H. Stemer; Gregory L. Mayback

(57) ABSTRACT

A continuous-flow steam generator includes a combustion chamber with evaporator tubes for fossil fuel. The combustion chamber is followed on the fuel-gas side by a vertical gas flue through a horizontal gas flue. When the continuous-flow steam generator is in operation, temperature differences in a connecting portion, which includes an outlet region of the combustion chamber and an inlet region of the horizontal gas flue, are to be kept particularly low. For such a purpose, of a plurality of evaporator tubes capable of being acted upon in parallel by flow medium, a number of evaporator tubes are guided in the form of a loop in the connecting portion.

23 Claims, 6 Drawing Sheets

FOSSIL-FIRED CONTINUOUS-FLOW STEAM GENERATOR

CROSS-REFERENCE TO RELATED APPLICATION

This application is a continuation of copending International Application No. PCT/DE00/00864, filed Mar. 20, 2000, which designated the United States.

BACKGROUND OF THE INVENTION

Field of the Invention

The invention lies in the field of power generation. The invention relates to a continuous-flow steam generator having a combustion chamber for fossil fuel that is followed on the fuel-gas side, through a horizontal gas flue, by a vertical gas flue. The containment walls of the combustion chamber are formed from vertically disposed evaporator tubes gastightly welded to one another.

In a power plant with a steam generator, the energy content of a fuel is utilized for evaporating a flow medium in the steam generator. In such a case, the flow medium is normally carried in an evaporator circuit. The steam supplied by the steam generator may, in turn, be provided, for example, for driving a steam turbine and/or for a connected external process. If the steam drives a steam turbine, a generator or a working machine is usually operated through the turbine shaft of the steam turbine. Where a generator is concerned, the current generated by the generator may be provided for feeding into an interconnected and/or island network.

The steam generator may, in this context, be configured as a continuous-flow steam generator. A continuous-flow steam generator is disclosed in the paper "Verdampferkonzepte für Benson-Dampferzeuger" ["Evaporator concepts for Benson steam generators"] by J. Franke, W. Köhler, and E. Wittchow, published in VGB Kraftwerkstechnik 73 (1993), No. 4, p. 352–360. In a continuous-flow steam generator, the heating of steam generator tubes provided as evaporator tubes leads to an evaporation of the flow medium in the steam generator tubes in a single pass.

Continuous-flow steam generators are conventionally configured with a combustion chamber in a vertical form of construction. As such, the combustion chamber is configured for the heating medium or fuel gas to flow through in an approximately vertical direction. In such a case, the combustion chamber may be followed on the fuel-gas side by a horizontal gas flue, a deflection of the fuel-gas stream into an approximately horizontal direction of flow taking place at the transition from the combustion chamber into the horizontal gas flue. However, in general, because of the thermally induced changes in length of the combustion chamber, such combustion chambers require a framework on which the combustion chamber is suspended. The suspension necessitates a considerable technical outlay in terms of the production and assembly of the continuous-flow steam generator, and the outlay is even greater when the overall height of the continuous-flow steam generator is larger. The increase is true, particularly with regard to continuous-flow steam generators that are configured for a steam power output of more than 80 kg/s under full load.

A continuous-flow steam generator is not subject to any pressure limitation, so that fresh-steam pressures well above the critical pressure of water ($P_{cri}$=221 bar), where there is still only a slight density difference between the liquid-like and steam-like media, are possible. A high fresh-steam pressure is conducive to high thermal efficiency and, therefore, to low $CO_2$ emissions of a fossil-fired power station that can be fired, for example, with hard coal or else with lignite in solid form as fuel.

A particular problem is presented by the construction of the containment wall of the gas flue or combustion chamber of the continuous-flow steam generator in terms of the tube-wall or material temperatures that occur there. In the subcritical pressure range down to about 200 bar, the temperature of the containment wall of the combustion chamber is determined essentially by the height of the saturation temperature of the water, when wetting of the inner surface of the evaporator tubes can be ensured. Such wetting is achieved, for example, by using evaporator tubes that have a surface structure on their inside. Consideration is given, in particular, to internally ribbed evaporator tubes, of which the use in a continuous-flow steam generator is present in the prior art, for example, from the paper quoted above. These so-called ribbed tubes, that is to say tubes with a ribbed inner surface, have particularly good heat transmission from the tube inner wall to the flow medium.

Experience has shown that it is not possible to avoid the situation, when the continuous-flow steam generator is in operation, where thermal stresses occur between adjacent tube walls of different temperature when these are welded to one another. Such stresses occur, in particular, with regard to the portion of the combustion chamber connecting the combustion chamber to the horizontal gas flue following the combustion chamber, in other words, between evaporator tubes of the outlet region of the combustion chamber and steam generator tubes of the inlet region of the horizontal gas flue. These thermal stresses can markedly reduce the useful life of the continuous-flow steam generator and, in an extreme case, may even give rise to tube cracks.

SUMMARY OF THE INVENTION

It is accordingly an object of the invention to provide a fossil-fired continuous-flow steam generator that overcomes the hereinafore-mentioned disadvantages of the heretofore-known devices of this general type and that requires a particularly low outlay in terms of production and assembly and, moreover, during the operation of which, keeps low temperature differences at the connection of the combustion chamber to the horizontal gas flue following the combustion chamber. The features apply particularly to the mutually directly or indirectly adjacent evaporator tubes of the combustion chamber and steam generator tubes of the horizontal gas flue following the combustion chamber.

With the foregoing and other objects in view, there is provided, in accordance with the invention, a continuous-flow steam generator, including a combustion chamber for combusting fossil fuel, the combustion chamber having a fuel-gas side, an outlet region, burners, and containment walls formed from vertically disposed evaporator tubes welded to one another in a gastight manner, a horizontal gas flue having an inlet region and being disposed level with respect to the burners of the combustion chamber, a vertical gas flue connected to the fuel-gas side of the combustion chamber through the horizontal gas flue, a connecting portion forming the outlet region of the combustion chamber and the inlet region of the horizontal gas flue, a plurality of the evaporator tubes respectively acted upon in parallel by a flow medium, and a number of the evaporator tubes formed in a loop in the connecting portion.

The continuous-flow steam generator has a combustion chamber with a number of burners disposed level with the horizontal gas flue. A plurality of the evaporator tubes is respectively acted upon in parallel by flow medium. A number of the evaporator tubes are acted upon in parallel by flow medium being led in the form of a loop in a connecting portion that is made of the outlet region of the combustion chamber and the inlet region of the horizontal gas flue.

The invention proceeds from the notion that a continuous-flow steam generator capable of being set up at a particularly low outlay in terms of production and assembly should have a suspension structure capable of being executed in a simple way. At the same time, a framework capable of being set up at a comparatively low technical outlay for the suspension of the combustion chamber can be accompanied by a particularly low overall height of the continuous-flow steam generator. A particularly low overall height of the continuous-flow steam generator can be achieved by the combustion chamber being configured in a horizontal form of construction. For such a purpose, the burners are disposed level with the horizontal gas flue in the combustion chamber wall. Thus, when the continuous-flow steam generator is in operation, the fuel gas flows through the combustion chamber in an approximately horizontal main direction of flow.

Moreover, when the continuous-flow steam generator with the horizontal combustion chamber is in operation, temperature differences should be particularly low at the connection of the combustion chamber to the horizontal gas flue, in order reliably to avoid premature material fatigues as a result of thermal stresses. These temperature differences should be especially low, in particular, between mutually directly or indirectly adjacent evaporator tubes of the combustion chamber and steam generator tubes of the horizontal gas flue, so that material fatigues as a result of thermal stresses are prevented particularly reliably in the outlet region of the combustion chamber and in the inlet region of the horizontal gas flue.

However, when the continuous-flow steam generator is in operation, the inlet portion of the evaporator tubes that is acted upon by flow medium has a comparatively lower temperature than the inlet portion of the steam generator tubes of the horizontal gas flue following the combustion chamber. To be precise, comparatively cold flow medium enters the evaporator tubes in contrast to the hot flow medium that enters the steam generator tubes of the horizontal gas flue. Hence, when the continuous-flow steam generator is in operation, the evaporator tubes are colder in the inlet portion than the steam generator tubes in the inlet portion of the horizontal gas flue. As such, material fatigues resulting from thermal stresses are to be expected at the connection between the combustion chamber and the horizontal gas flue.

However, if preheated flow medium then enters the inlet portion of the evaporator tubes of the combustion chamber, instead of cold flow medium, the temperature difference between the inlet portion of the evaporator tubes and the inlet portion of the steam generator tubes will no longer be as great as would be the case if cold flow medium were to enter the evaporator tubes. If, therefore, the flow medium is led first in a first evaporator tube, which is disposed further away from the connection of the combustion chamber to the horizontal gas flue than a second evaporator tube, and is then introduced into the second evaporator tube, flow medium preheated by firing enters the second evaporator tube when the continuous-flow steam generator is in operation. The complicated connection between a first and a second evaporator tube may be dispensed with if one evaporator tube has an inlet for flow medium in the middle of the containment wall of the combustion chamber. Then, such an evaporator tube can be led first from the top downward and then from the bottom upward in the combustion chamber. Consequently, when the continuous-flow steam generator is in operation, firing causes a preheating of the flow medium to take place in that portion of the evaporator tube that is led from the top downward, before the flow medium enters the so-called inlet portion of the evaporator tubes in the lower region of the combustion chamber. It proves to be particularly beneficial, at the same time, if a number of the evaporator tubes capable of being acted upon in parallel by flow medium are led in the form of a loop in the respective containment wall of the combustion chamber.

In accordance with another feature of the invention, the side walls of the horizontal gas flue and/or of the vertical gas flue are advantageously formed from vertically disposed steam generator tubes welded to one another in a gastight manner and capable of being acted upon in each case in parallel by flow medium.

In accordance with a further feature of the invention, advantageously, in each case, a number of parallel-connected evaporator tubes of the combustion chamber are preceded, with respect to a direction of flow of the flow medium, by a common inlet header system and are followed by a common outlet header system for flow medium. To be precise, such a continuous-flow steam generator allows for reliable pressure compensation between a number of evaporator tubes capable of being acted upon in parallel by flow medium. Accordingly, in each case, all parallel-connected evaporator tubes between the inlet header system and the outlet header system have the same overall pressure loss. As a result, in the case of an evaporator tube heated to a greater extent, the throughput must rise, as compared with an evaporator tube heated to a lesser extent. The characteristic also applies to the steam generator tubes of the horizontal gas flue or of the vertical gas flue that are capable of being acted upon in parallel by flow medium and that are advantageously preceded by a common inlet header system for flow medium and followed by a common outlet header system for flow medium.

In accordance with an added feature of the invention, the evaporator tubes of the end wall of the combustion chamber are advantageously capable of being acted upon in parallel by flow medium and precede the evaporator tubes of the containment walls, which form the side walls of the combustion chamber, on the flow-medium side. The configuration ensures particularly favorable cooling of the highly heated end wall of the combustion chamber.

In accordance with an additional feature of the invention, evaporator tubes of the end wall of the combustion chamber precede other containment walls of the combustion chamber in a direction of the flow-medium.

In accordance with yet another feature of the invention, the tube inside diameter of a number of the evaporator tubes of the combustion chamber is selected as a function of the respective position of the evaporator tubes in the combustion chamber. The evaporator tubes in the combustion chamber can be adapted thereby to a heating profile predeterminable on the fuel-gas side. Due to the influence brought about thereby on the flow through the evaporator tubes, temperature differences of the flow medium at the outlet from the evaporator tubes of the combustion chamber are kept particularly low in a particularly reliable way.

For particularly good heat transmission from the heat of the combustion chamber to the flow medium carried in the evaporator tubes, in accordance with yet a further feature of the invention, a number of evaporator tubes advantageously have in each case, on their inside, ribs that form a multiflight thread. Advantageously, a pitch angle $\alpha$ between a plane perpendicular to the tube axis and the flanks of the ribs disposed on the tube inside is smaller than 60°, and, preferably, smaller than 55°.

To be precise, in a heated evaporator tube configured as an evaporator tube without internal ribbing, a so-called smooth tube, the wetting of the tube wall, necessary for particularly good heat transmission, can no longer be maintained from a specific steam content onward. With a lack of wetting, there may be a tube wall that is dry in places. The transition to such a dry tube wall leads to a so-called heat transmission crisis with an impaired heat transmission behavior, so that, in general, the tube wall temperatures rise particularly sharply at the point. In an internally ribbed evaporator tube, however, as compared with a smooth tube, the heat transmission crisis arises only in the case of a steam mass content>0.9, that is to say just before the end of evaporation. The effect is attributable to the swirl that the flow experiences due to the spiral ribs. Due to the different centrifugal force, the water fraction is separated from the steam fraction and is transported to the tube wall. The wetting of the tube wall is thereby maintained up to high steam contents, so that there are already high flow velocities at the location of the heat transmission crisis. The configuration gives rise, despite the heat transmission crisis, to relatively good heat transmission and, consequently, to low tube wall temperatures.

In accordance with yet an added feature of the invention, a number of evaporator tubes of the combustion chamber advantageously have a device or means for reducing the throughflow of the flow medium. In such a case, it proves particularly beneficial if the device is configured as throttle devices. Throttle devices may, for example, be fittings in the evaporator tubes, which reduce the tube inside diameter at a point within the respective evaporator tube. At the same time, a device or means for reducing the throughflow in a line system that includes a plurality of parallel lines and through which flow medium can be fed to the evaporator tubes of the combustion chamber also prove to be advantageous. In such a case, the line system may also precede an inlet header system of evaporator tubes capable of being acted upon in parallel by flow medium. For example, throttle assemblies may be provided in one line or in a plurality of lines in the line system. Such devices for reducing the throughflow of the flow medium through the evaporator tubes make it possible to adapt the throughput of the flow medium through individual evaporator tubes to the respective heating of these in the combustion chamber. As a result, in addition, temperature differences of the flow medium at the outlet of the evaporator tubes are kept particularly low in a particularly reliable way.

In accordance with yet an additional feature of the invention, the evaporator tubes and the steam generator tubes have fins, adjacent ones of at least one of the evaporator tubes and the steam generator tubes are welded to one another in a gastight manner by the fins, and each of the fins have a fin width selected as a function of a respective position of a corresponding one of the evaporator tubes and the steam generator tubes in at least one of the combustion chamber, the horizontal gas flue, and the vertical gas flue. Adjacent evaporator or steam generator tubes are welded to one another in a gastight manner on their longitudinal sides advantageously through metal bands, also referred to as fins. These fins can be connected fixedly to the tubes even during the tube production process and can form a unit therewith. The unit formed from a tube and fins is also designated as finned tube. The fin width influences the introduction of heat into the evaporator or steam generator tubes. The fin width is, therefore, adapted to a heating profile predeterminable on the flow-gas side, preferably as a function of the position of the respective evaporator or steam generator tubes in the continuous-flow steam generator. The heating profile so predetermined may be a typical heating profile determined from experimental values or else a rough estimation, such as, for example, a stepped heating profile. By the suitably selected fin widths, even when different evaporator or steam generator tubes are heated to a widely differing extent, an introduction of heat into all the evaporator or steam generator tubes can be achieved such that temperature differences of the flow medium at the outlet from the evaporator or steam generator tubes are kept particularly low. As such, premature material fatigues as a result of thermal stresses are reliably prevented. As a result, the continuous-flow steam generator has a particularly long useful life.

In accordance with again another feature of the invention, the horizontal gas flue advantageously has disposed in it a number of superheater heating surfaces that are disposed approximately perpendicularly to the main direction of flow of the fuel gas and the tubes of which are connected in parallel for the throughflow of the flow medium. These superheater heating surfaces, disposed in a suspended form of construction and also designated as bulkhead heating surfaces, are heated predominantly by convection and follow the evaporator tubes of the combustion chamber on the flow-medium side. A particularly favorable utilization of the fuel-gas heat is thereby ensured.

In accordance with again a further feature of the invention, advantageously, the vertical gas flue has a number of convection heating surfaces that are formed from tubes disposed approximately perpendicularly to the main direction of flow of the fuel gas. These tubes of a convection heating surface are connected in parallel for a throughflow of the flow medium. These convection heating surfaces, too, are heated predominantly by convection.

In order, furthermore, to ensure the particularly full utilization of the heat of the fuel gas, the vertical gas flue advantageously has an economizer.

In accordance with again an added feature of the invention, there are provided convection heating surfaces disposed in the vertical gas flue.

In accordance with again an additional feature of the invention, the combustion chamber has a length defined by a distance between the end wall of the combustion chamber and the inlet region of the horizontal gas flue, and the length is at least equal to a burnup length of the fuel in a full-load mode of the continuous-flow steam generator. Advantageously, the burners are disposed on the end wall of the combustion chamber, that is to say on that side wall of the combustion chamber that is located opposite the outflow orifice to the horizontal gas flue. A continuous-flow steam generator so configured can be adapted particularly simply to the burnup length of the fossil fuel. The burnup length of the fossil fuel refers, in this context, to the fuel-gas velocity in the horizontal direction at a specific average fuel-gas temperature, multiplied by the burnup time $t_A$ of the flame of the fossil fuel. The maximum burnup length for the respective continuous-flow steam generator is obtained, in such a case, from the steam power output M under the full load of the continuous-flow steam generator, the so-called full-load mode. The burnup time $t_A$ of the flame of the fossil fuel is, in turn, the time that, for example, a coaldust grain of average size requires to burn up completely at a specific average fuel-gas temperature.

In accordance with still another feature of the invention, advantageously, the lower region of the combustion chamber is configured as a funnel. As such, when the continuous-flow steam generator is in operation, ash occurring during the combustion of the fossil fuel can be discharged particularly simply, for example, into an ash removal device disposed under the funnel. The fossil fuel may be coal in solid form.

To keep material damage and undesirable contamination of the horizontal gas flue, for example, due to the introduction of high-temperature molten ash, particularly low, the length of the combustion chamber, defined by the distance from the end wall to the inlet region of the horizontal gas flue, is advantageously at least equal to the burnup length of the fossil fuel in the full-load mode of the continuous-flow steam generator. The horizontal length of the combustion chamber will generally amount to at least 80% of the height of the combustion chamber, measured from the funnel top edge, when the lower region of the combustion chamber has a funnel-shaped construction, to the combustion chamber ceiling.

For a particularly beneficial utilization of the combustion heat of the fossil fuel, in accordance with a concomitant feature of the invention, the length L (given in meters) of the combustion chamber is selected as a function of the steam power output M (given in kg/s) of the continuous-flow steam generator under full load, of the burnup time $t_A$ (given in seconds) of the flame of the fossil fuel, and of the outlet temperature $t_{BRK}$ (given in ° C.) of the fuel gas from the combustion chamber. With the given steam power output M of the continuous-flow steam generator under full load, approximately the higher value of the two functions (I) and (II) applies to the length L of the combustion chamber:

$$L(M, t_A) = (C_1 + C_2 \cdot M) \cdot t_A \quad \text{(I)}$$

and $$L\ (M, T_{BRK}) = (C_3 \cdot T_{BRK} + C_4)M + C_5(T_{BRK})^2 + C_6 \cdot T_{BRK} + C_7 \quad \text{(II)},$$

where:

$C_1$=8 m/s;

$C_2$=0.0057 m/kg;

$C_3$=$-1.905 \cdot 10^{-4}$(m·s)/(kg° C.);

$C_4$=0.286 (s·m)/kg;

$C_5$=$3 \cdot 10^{-4}$ m/(° C.)$^2$;

$C_6$=−0.842 m/° C.; and $C_7$=603.41 m,

"Approximately" as defined herein means that a permissible deviation in the length L of the combustion chamber of +20%/−10% from the value defined by the respective function.

The advantages achieved by the invention are, in particular, that, by guiding some evaporator tubes in the form of a loop in the containment wall of the combustion chamber, temperature differences in the immediate vicinity of the connection of the combustion chamber to the horizontal gas flue when the continuous-flow steam generator is in operation are particularly low. Consequently, when the continuous-flow steam generator is in operation, the thermal stresses at the connection of the combustion chamber to the horizontal gas flue that are caused by temperature differences between directly adjacent evaporator tubes of the combustion chamber and steam generator tubes of the horizontal gas flue remain well below the values at which, for example, there is a risk of pipe cracks. It is, therefore, possible to use a horizontal combustion chamber in a continuous-flow steam generator, even at the same time with a comparatively long useful life. Moreover, configuring the combustion chamber for an approximately horizontal main direction of flow of the fuel gas affords a particularly compact form of construction of the continuous-flow steam generator. The configuration makes it possible, when the continuous-flow steam generator is incorporated into a power station with a steam turbine, also to have particularly short connecting pipes from the continuous-flow steam generator to the steam turbine.

Other features that are considered as characteristic for the invention are set forth in the appended claims.

Although the invention is illustrated and described herein as embodied in a fossil-fired continuous-flow steam generator, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
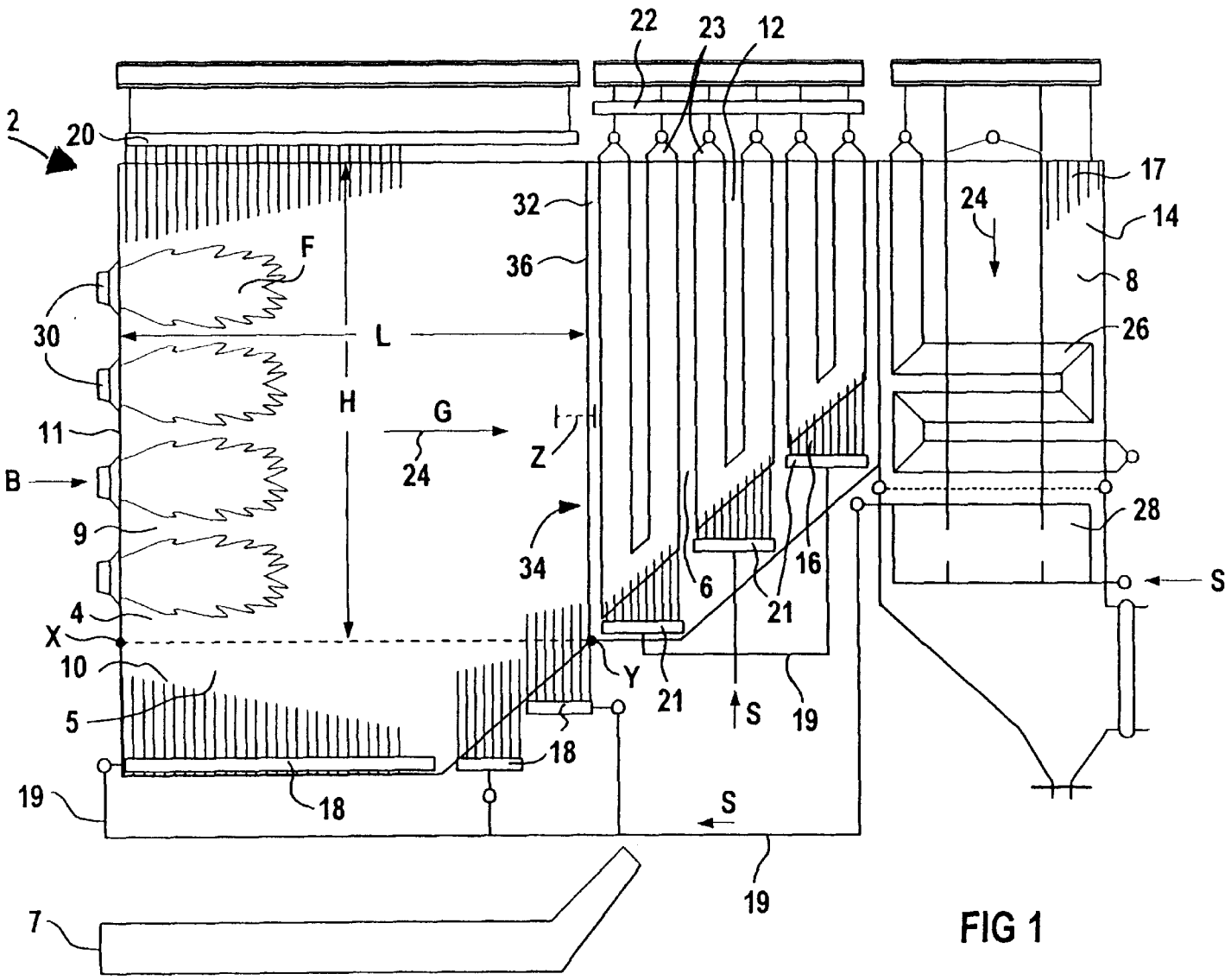
FIG. 1 is a diagrammatic illustration of a side view of a fossil-fired continuous-flow steam generator of the dual-flue type according to the invention.

In all the figures of the drawing, sub-features and integral parts that correspond to one another bear the same reference symbol in each case.

Referring now to the figures of the drawings in detail and first, particularly to FIG. 1 thereof, there is shown a fossil-firable continuous-flow steam generator 2 for a non-illustrated power plant, also including a steam turbine plant. In such a case, the continuous-flow steam generator 2 is configured for a steam power output under full load of at least 80 kg/s. The steam generated in the continuous-flow steam generator 2 is utilized for driving the steam turbine that itself, in turn, drives a generator for current generation. The current generated by the generator is intended for feeding into an interconnected or island network.

The fossil-fired continuous-flow steam generator 2 includes a combustion chamber 4 that is configured in a horizontal form of construction and that is followed on the fuel-gas side, through a horizontal gas flue 6, by a vertical gas flue 8. The lower region of the combustion chamber 4 is formed by a funnel 5 with a top edge corresponding to the subsidiary line having the end points X and Y. When the continuous-flow steam generator 2 is in operation, ash from the fossil fuel B can be discharged through the funnel 5 into an ash removal device 7 disposed under the latter. The containment walls 9 of the combustion chamber 4 are formed from vertically disposed evaporator tubes 10 that are welded to one another in a gastight manner and the number N of which can be acted upon in parallel by flow medium S. One containment wall 9 of the combustion chamber 4 is the end wall 11. In addition, the side walls 12 of the horizontal gas flue 6 and 14 of the vertical gas flue 8 are also formed from vertically disposed steam generator tubes 16 and 17 welded to one another in a gastight manner. A number of the steam generator tubes 16 and 17 can be acted upon respectively in parallel by flow medium S.

A number of evaporator tubes 10 of the combustion chamber 4 are, on the flow-medium side, preceded by an inlet header system 18 for flow medium S and followed by an outlet header system 20. The inlet header system 18 includes a number of parallel inlet headers. At the same time, a line system 19 is provided for feeding flow medium S into the inlet header system 18 of the evaporator tubes 10. The line system 19 includes a plurality of parallel-connected lines that are in each case connected to one of the inlet headers of the inlet header system 18.

In the same way, the steam generator tubes 16, capable of being acted upon in parallel by flow medium S, of the side walls 12 of the horizontal gas flue 6 are preceded by a common inlet header system 21 and followed by a common outlet header system 22. A line system 19 is likewise provided for feeding flow medium S into the inlet header system 21 of the steam generator tubes 16. Here, too, the line system includes a plurality of parallel-connected lines that are connected in each case to one of the inlet headers of the inlet header system 21.

By virtue of the configuration of the continuous-flow steam generator 2 with inlet header systems 18, 21 and outlet header systems 20, 22, particularly reliable pressure compensation between the parallel-connected evaporator tubes 10 of the combustion chamber 4 and the parallel-connected steam generator tubes 16 of the horizontal gas flue 6 is possible in that respectively all the parallel-connected evaporator or steam generator tubes 10 and 16 have the same overall pressure loss. In other words, the throughput must rise in an evaporator tube 10 or steam generator tube 16 heated to a greater extent, as compared with an evaporator tube 10 or steam generator tube 16 heated to a lesser extent.

Figure 2:
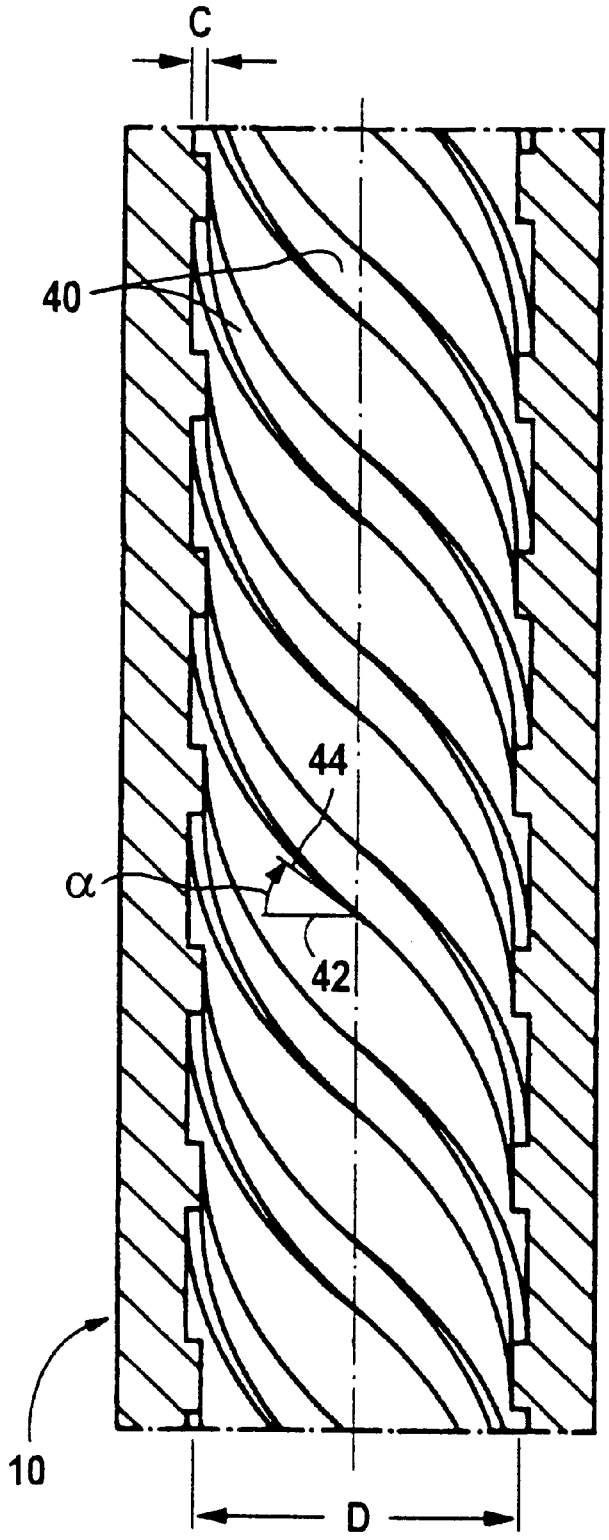
FIG. 2 is a fragmentary, diagrammatic, longitudinal cross-sectional view through an individual evaporator tube of FIG. 1.

As illustrated in FIG. 2, the evaporator tubes 10 have a tube inside diameter D and, on their inside, ribs 40 that form a type of multiflight thread and have a rib height C. The pitch angle $\alpha$ between a plane 42 perpendicular to the tube axis and the flanks 44 of the ribs 40 disposed on the tube inside is smaller than 55°. As a result, a particularly high transmission of heat from the inner walls of the evaporator tubes 10 to the flow medium S carried in the evaporator tubes 10 and, at the same time, particularly low temperatures of the tube wall are achieved.

The tube inside diameter D of the evaporator tubes 10 of the combustion chamber 4 is selected as a function of the respective position of the evaporator tubes 10 in the combustion chamber 4. The continuous-flow steam generator 2 is thereby adapted to the different heating of the evaporator tubes 10. The configuration of the evaporator tubes 10 of the combustion chamber 4 ensures particularly reliability in that temperature differences of the flow medium S at the outlet from the evaporator tubes 10 are kept particularly low.

Some of the evaporator tubes 10 are equipped with non-illustrated throttle devices as means for reducing the throughflow of the flow medium S. The throttle devices are configured as perforated diaphragms reducing the tube inside diameter D at one point and, when the continuous-flow steam generator 2 is in operation, have the effect of reducing the throughput of the flow medium S in evaporator tubes 10 heated to a lesser extent. As a result, the throughput of the flow medium S is adapted to the heating.

Furthermore, one or more lines of the line system 19, which are not illustrated in any more detail, are equipped with throttle devices, in particular, throttle assemblies, as means for reducing the throughput of the flow medium S in the evaporator tubes 10.

Adjacent evaporator or steam generator tubes 10, 16, 17 are welded to one another in a gastight manner on their longitudinal sides through non-illustrated fins. To be precise, the heating of the evaporator or steam generator tubes 10, 16, 17 can be influenced by a suitable choice of the fin width. Therefore, the respective fin width is adapted to a heating profile that is predeterminable on the fuel-gas side and that depends on the position of the respective evaporator or steam generator tubes 10, 16, 17 in the continuous-flow steam generator 2. The heating profile may be a typical heating profile determined from experimental values or else by a rough estimation. Consequently, even when the evaporator or steam generator tubes 10, 16, 17 are heated to a greatly differing extent, temperature differences at the outlet of the evaporator or steam generator tubes 10, 16, 17 are kept particularly low. Therefore, material fatigues as a result of thermal stresses are reliably prevented, thus ensuring that the continuous-flow steam generator 2 has a long useful life.

When the horizontal combustion chamber 4 is being fitted with tubes, it must be borne in mind that the heating of the individual evaporator tubes 10 connected to one another in a gastight manner varies greatly when the continuous-flow steam generator 2 is in operation. The configuration of the evaporator tubes 10 in terms of their internal ribbing, their fin connection to adjacent evaporator tubes 10, and their tube inside diameter D is, therefore, selected such that, in spite of different heating, all the evaporator tubes 10 have approximately the same outlet temperatures of the flow medium S and sufficient cooling of all the evaporator tubes 10 is ensured for all the operating states of the continuous-flow steam generator 2. A heating of some evaporator tubes 10 to a lesser extent when the continuous-flow steam generator 2 is in operation is taken into account additionally by the fitting of throttle devices.

The tube inside diameters D of the evaporator tubes 10 in the combustion chamber 4 are selected as a function of their respective position in the combustion chamber 4. The evaporator tubes 10 that are exposed to greater heating when the continuous-flow steam generator 2 is in operation have a larger tube inside diameter D than evaporator tubes 10 that are heated to a lesser extent when the continuous-flow steam generator 2 is in operation. What is ensured thereby, as compared with the situation where the tube inside diameters are the same, is that the throughput of the flow medium S is increased in the evaporator tubes 10 with a larger tube inside diameter D and temperature differences at the outlet of the evaporator tubes 10 are thereby reduced as a result of different heating. A further measure for adapting the flow of flow medium S through the evaporator tubes 10 to the heating is to fit throttle devices into some of the evaporator tubes 10 and/or into the line system 19 provided for feeding flow medium S. In contrast, to adapt the heating to the throughput of the flow medium S through the evaporator tubes 10, the fin width may be selected as a function of the position of the evaporator tubes 10 in the combustion chamber 4. All the measures mentioned give rise, despite a widely varying heating of the individual evaporator tubes 10, to an approximately identical specific heat absorption of the flow medium S carried in the evaporator tubes 10, when the continuous-flow steam generator 2 is in operation, and, therefore, to only slight temperature differences of the flow medium S at its outlet. The internal ribbing of the evaporator tubes 10 is configured such that, in spite of different heating and a different throughflow of flow medium S, particularly reliable cooling of the evaporator tubes 10 is ensured in all the load states of the continuous-flow steam generator 2.

The horizontal gas flue 6 has a number of superheater heating surfaces 23 (configured as bulkhead heating surfaces) that are disposed in a suspended form of construction approximately perpendicularly to the main direction of flow 24 of the fuel gas G and the tubes of which are respectively connected in parallel for a throughflow of the flow medium S. The superheater heating surfaces 23 are heated predominantly by convection and follow the evaporator tubes 10 of the combustion chamber 4 on the flow-medium side.

The vertical gas flue 8 has a number of convection heating surfaces 26 that are capable of being heated predominantly by convection and are formed from tubes disposed approximately perpendicularly to the main direction of flow 24 of the fuel gas G. These tubes are respectively connected in parallel for a throughflow of the flow medium S. Moreover, an economizer 28 is disposed in the vertical gas flue 8. On the outlet side, the vertical gas flue 8 issues into a further heat exchanger, for example, into an air preheater and, from there, through a dust filter, to a chimney. The components following the vertical gas flue 8 are not illustrated in any more detail in the drawing for clarity.

The continuous-flow steam generator 2 is configured with a horizontal combustion chamber 4 of particularly low overall height and can, therefore, be set up at a particularly low outlay in terms of production and assembly. The combustion chamber 4 of the continuous-flow steam generator 2 has a number of burners 30 for fossil fuel B. The burners 30 are disposed, level with the horizontal gas flue 6, on the end wall 11 of the combustion chamber 4. The fossil fuel B may be a solid fuel, in particular, coal.

So that the fossil fuel B (i.e., coal in solid form) burns up particularly completely to achieve particularly high efficiency and to reliably prevent material damage to the first superheater heating surface 23 of the horizontal gas flue 6, as seen on the fuel-gas side and contamination of the first superheater heating surface 23 (i.e., by the introduction of high-temperature molten ash), the length L of the combustion chamber 4 is selected such that it exceeds the burnup length of the fossil fuel B in the full-load mode of the continuous-flow steam generator 2. The length L is the distance from the end wall 11 of the combustion chamber 4 to the inlet region 32 of the horizontal gas flue 6. The burnup length of the fossil fuel B is defined as the fuel-gas velocity in the horizontal direction at a specific average fuel-gas temperature, multiplied by the burnup time $t_A$ of the flame F of the fossil fuel B. The maximum burnup length for the respective continuous-flow steam generator 2 is obtained in the full-load mode of the respective continuous-flow steam generator 2. The burnup time $t_A$ of the flame F of the fuel B is, in turn, the time that, for example, a coal dust grain of average size requires to burn up completely at a specific average fuel-gas temperature.

To ensure a particularly beneficial utilization of the combustion heat of the fossil fuel B, the length L (given in meters) of the combustion chamber 4 is suitably selected as a function of the outlet temperature $T_{BRK}$ (given in ° C.) of the fuel gas G from the combustion chamber 4, of the burnup time $t_A$ (given in seconds) of the flame F of the fossil fuel B and of the steam power output M (given in kg/s) of the continuous-flow steam generator 2 under full load. The horizontal length L of the combustion chamber 4 amounts in the case of the embodiment to at least 80% of the height H of the combustion chamber 4. The height H is in the embodiment measured from the top edge of the funnel 5 of the combustion chamber 4, marked in FIG. 1 by the subsidiary line having the end points X and Y, to the combustion chamber ceiling. The length L of the combustion chamber 4 is determined approximately by the functions (I) and (II):

$$L\ (M,\ t_A)=(C_1+C_2\cdot M)\cdot t_A \qquad \text{(I)}$$

and $$L\ (M,\ T_{BRK})=(C_3\cdot T_{BRK}+C_4)M+C_5(T_{BRK})^2+C_6\cdot T_{BRK}+C_7 \qquad \text{(II)},$$

where:

$C_1$=8 m/s;

$C_2$=0.0057 m/kg;

$C_3=-1.905\cdot 10^{-4}$(m·s)/(kg° C.);

$C_4$=0.286 (s·m)/kg;

$C_5=3\cdot 10^{-4}$ m/(° C.)$^2$;

$C_6$=−0.842 m/° C.; and $C_7$=603.41 m,

What is to be understood here by the word "approximately" is that a permissible deviation of the length L of the combustion chamber 4 of +20%/−10% from the value defined by the respective function is permitted. In the embodiment, the higher value from the functions (I) and (II) for the length L of the combustion chamber 4 applies to the configuration of the continuous-flow steam generator 2 for a predetermined steam power output M of the continuous-flow steam generator 2 under full load.

Figure 3:
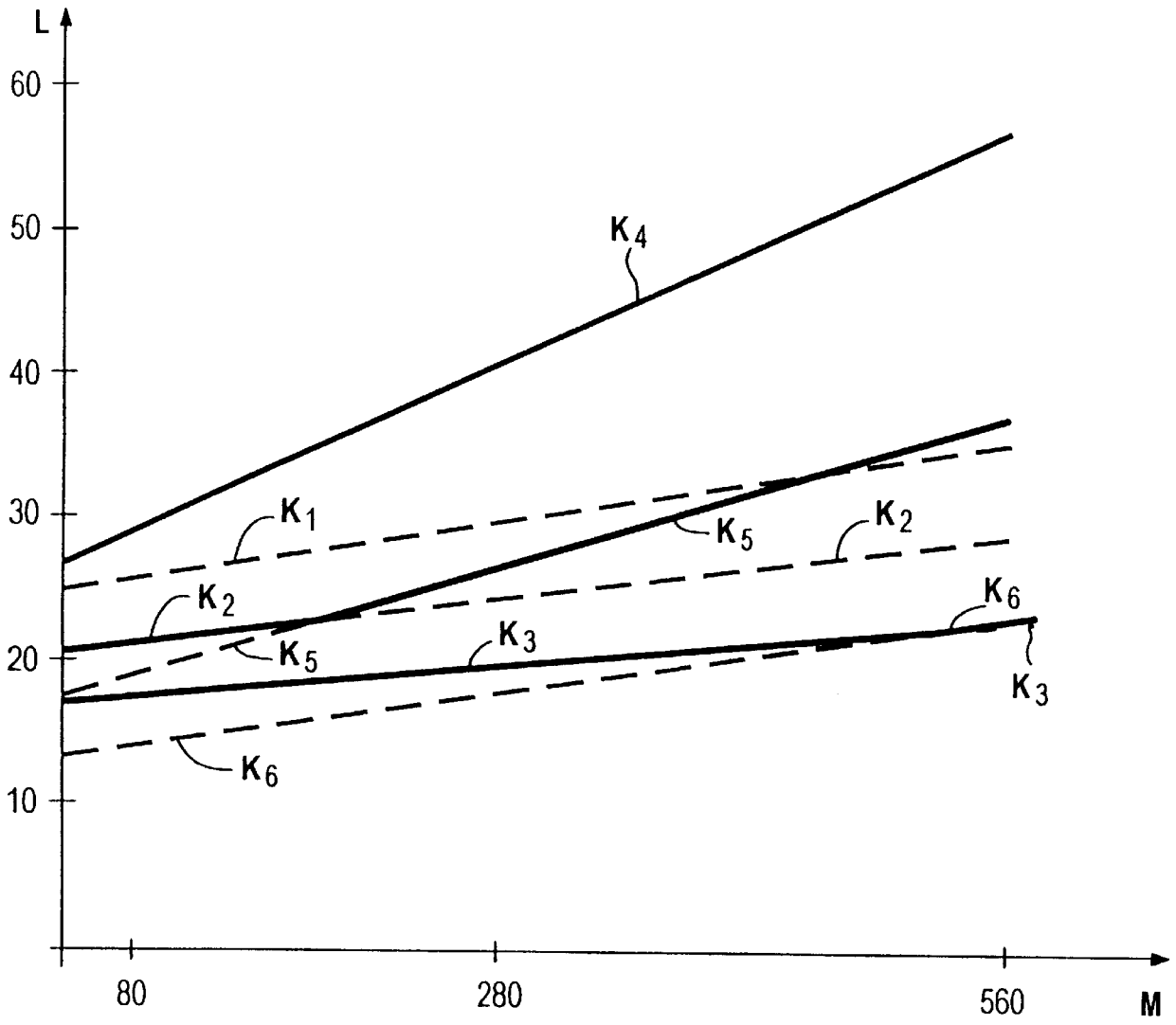
FIG. 3 is a graph illustrating lengths of a combustion chamber as a function of the steam power output according to the invention.

As an example of a possible configuration of the continuous-flow steam generator 2, six curves $K_1$ to $K_6$ are plotted in the coordinate system according to FIG. 3 for some lengths L of the combustion chamber 4 as a function of the steam power output M of the continuous-flow steam generator 2 under full load. Here, the curves are respectively allocated the following parameters:

$K_1$: $t_A$=3 s according to (I);

$K_2$: $t_A$=2.5 s according to (I);

$K_3$: $t_A$=2 s according to (I);

$K_4$: $T_{BRK}$=1200° C. according to (II);

$K_5$: $T_{BRK}$=1300° C. according to (II); and $K_6$: $T_{BRK}$=1400° C. according to (II).

Thus, for example, for the burnup time $t_A$=3 s of the flame F of the fossil fuel B and the outlet temperature $T_{BRK}$=1200° C. of the fuel gas G from the combustion chamber 4, curves $K_1$ and $K_4$ are to be used for determining the length L of the combustion chamber 4. The example results, in the case of a predetermined steam power output M of the continuous-flow steam generator 2 under full load of:

M=80 kg/s, in a length of L=29 m according to $K_4$;

M=160 kg/s, in a length of L=34 m according to $K_4$; and

M=560 kg/s, in a length of L=57 m according to $K_4$.

The curve $K_4$ drawn as an unbroken line is, therefore, always applicable.

For the burnup time $t_A$=2.5 s of the flame F of the fossil fuel B and the outlet temperature of the fuel gas G from the combustion chamber $T_{BRK}$=1300° C., it is necessary, for example, to use curves $K_2$ and $K_5$. The example results, in the case of a predetermined steam power output M of the continuous-flow steam generator 2 under full load of:

M=80 kg/s, in a length of L=21 m according to $K_2$;

M=180 kg/s, in a length of L=23 m according to $K_2$ and $K_5$; and

M=560 kg/s, in a length of L=37 m according to $K_5$.

Hence, up to M=180 kg/s, that part of the curve $K_2$ that is drawn as an unbroken line is applicable, but not the curve $K_5$ drawn as a broken line in the value range of M. For values of M that are higher than 180 kg/s, that part of the curve $K_5$ that is drawn as an unbroken line is applicable, but not the curve $K_2$ drawn as a broken line in the value range of M.

The burnup time $t_A$=2 s of the flame F of the fossil fuel B and the outlet temperature $T_{BRK}$=1400° C. of the fuel gas G from the combustion chamber 4 are associated with, for example, the curves $K_3$ and $K_6$. The example results, in the case of a predetermined steam power output M of the continuous-flow steam generator 2 under full load of:

M=80 kg/s, in a length of L=18 m according to $K_3$;

M=465 kg/s, in a length of L=21 m according to $K_3$ and $K_6$; and

M=560 kg/s, in a length of L=23 m according to $K_6$.

Hence, for the values of M up to 465 kg/s, the curve $K_3$ drawn as an unbroken line in the range is applicable, but not the curve $K_6$ drawn as a broken line in the range. For values of M that are higher than 465 kg/s, that part of the curve $K_6$ drawn as an unbroken line is applicable, but not the part of the curve $K_3$ drawn as a broken line.

So that comparatively small temperature differences occur between the outlet region 34 of the combustion chamber 4 and the inlet region 32 of the horizontal gas flue 6 when the continuous-flow steam generator 2 is in operation, the evaporator tubes 50 and 52 are guided in a particular way in the connecting portion Z marked in FIG. 1. The connecting portion Z is illustrated in detail in an alternative version in FIGS. 4 and 5 and includes the outlet region 34 of the combustion chamber 4 and the inlet region 32 of the horizontal gas flue 6. In the embodiment, the evaporator tube 50 is an evaporator tube 10, welded directly to the side wall 12 of the horizontal gas flue 6, of the containment wall 9 of the combustion chamber 4 and the evaporator tube 52 is an evaporator tube 10, directly adjacent to the evaporator tube 50, of the containment wall 9 of the combustion chamber 4. The steam generator tube 54 is a steam generator tube 16, welded directly to the containment wall 9 of the combustion chamber 4, of the horizontal gas flue 6, and the steam generator tube 56 is a steam generator tube 10, directly adjacent to the steam generator tube 16, of the side wall 12 of the horizontal gas flue 6.

Figure 4:
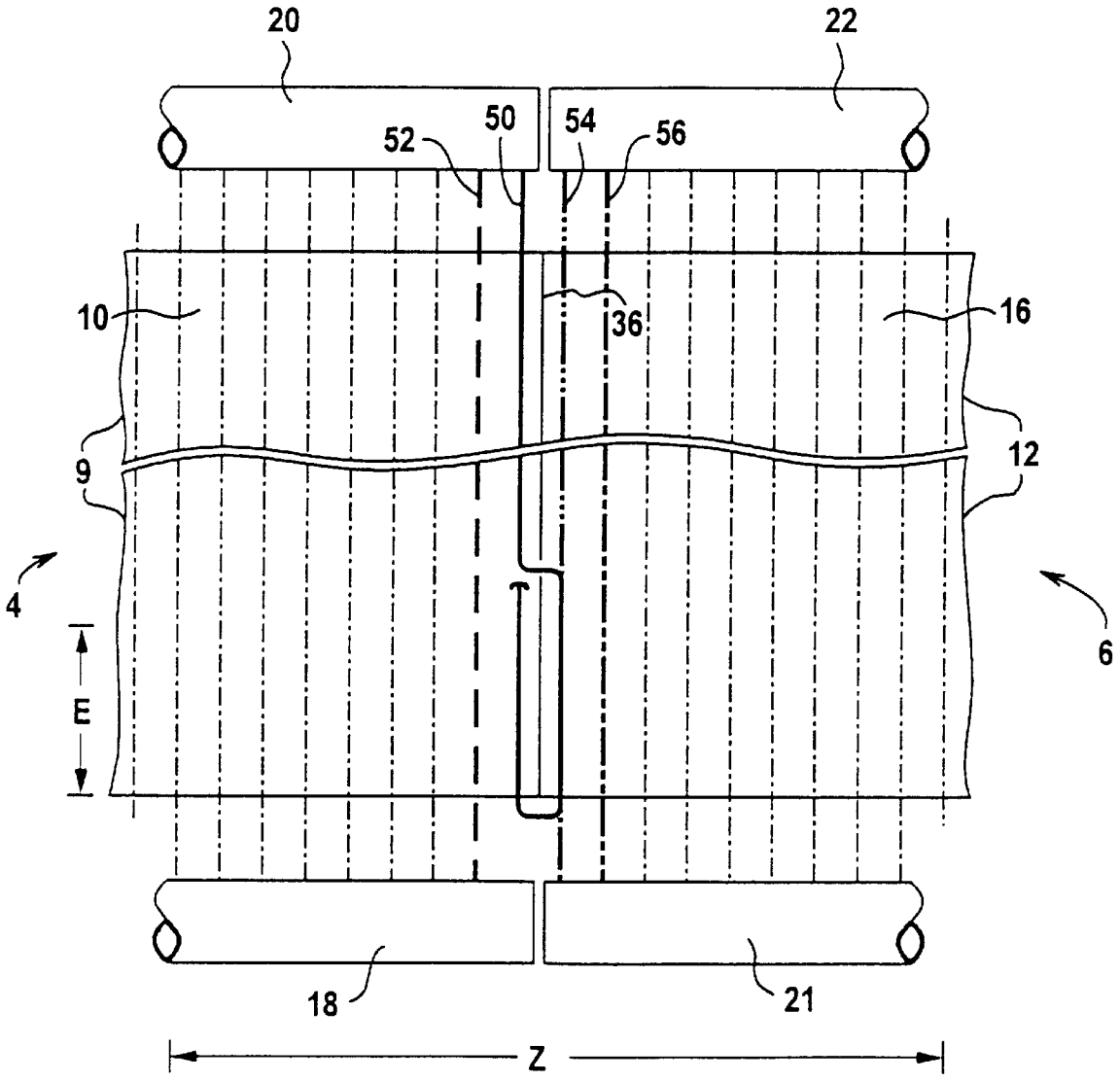
FIG. 4 is a fragmentary diagrammatic view of a portion connecting the combustion chamber of FIG. 1 to the horizontal gas flue.

According to FIG. 4, the evaporator tube 50 enters the containment wall 9 of the combustion chamber 4 only above the inlet portion E of the containment wall 9. The evaporator tube 50 is connected on the inlet side to the economizer 28 through the line system 19. As a result, venting of the evaporator tube 50 before the start-up of the continuous-flow steam generator 2 is achieved and, therefore, a particularly reliable flow through the continuous-flow steam generator 2 is achieved. The evaporator tube 50 is provided initially for carrying the flow medium S from the top downward. The routing of the evaporator tube 50 then changes through 180° in the immediate vicinity of the inlet header system 18 so that a flow of the flow medium S can then take place in the evaporator tube 50 from the bottom upward. Above the point at which the evaporator tube 50 has entered the containment wall 9 of the combustion chamber 4, the evaporator tube 50 is guided upward in the containment wall 9 so as to be laterally offset by one tube division in the direction of the burners 30. In the last portion, therefore, the evaporator tube 50 is guided in vertical alignment with the first portion of the evaporator tube 50.

The steam generator tube 54 of the side wall 12 of the horizontal gas flue 6, after emerging from the inlet header system 21, is guided firstly outside the side wall 12 of the horizontal gas flue 6. The steam generator tube 54 enters the side wall 12 of the horizontal gas flue 6 only above the point at which the evaporator tube 50 is guided further along in a laterally offset manner. At the connection 36 between the containment wall 9 of the combustion chamber 4 and the side wall 12 of the horizontal gas flue 6, therefore, the lower part belongs to the containment wall 9 of the combustion chamber 4 and the upper part to the side wall 12 of the horizontal gas flue 6. In the same way as the other evaporator tubes 10 and steam generator tubes 16, the evaporator tube 52 and the steam generator tube 56 are guided vertically in the containment wall 9 of the combustion chamber 4 and in the side wall 12 of the horizontal gas flue 6 go respectively and are connected on the inlet side to the inlet header system 18 and 21 and on the outlet side to the outlet header system 20 and 22.

Figure 5:
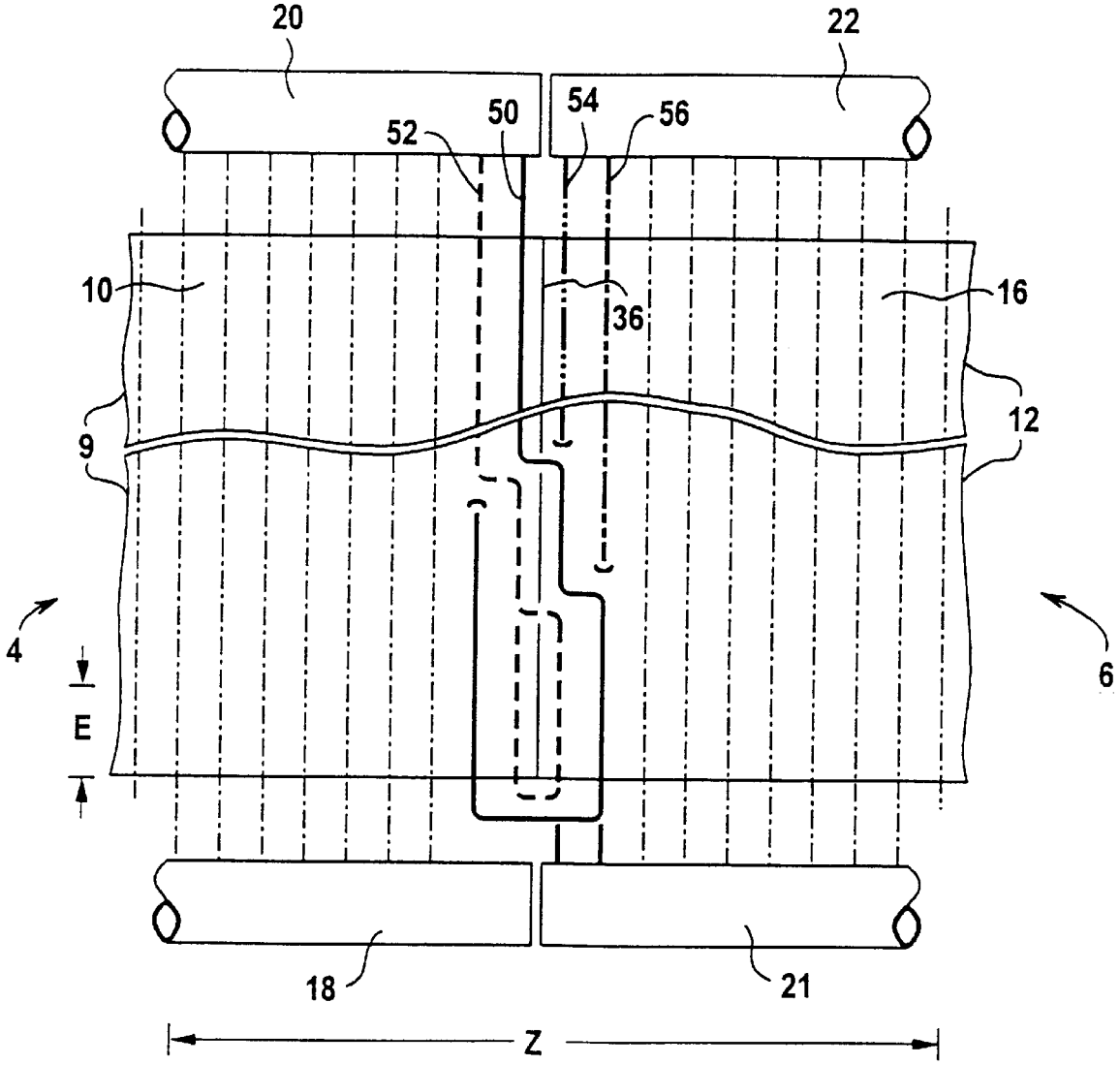
FIG. 5 is a fragmentary diagrammatic view of an alternative embodiment of the portion of FIG. 4 connecting the combustion chamber to the horizontal gas flue.

Another possible embodiment of the portion Z connecting the containment wall 9 of the combustion chamber 4 to the side wall 12 of the horizontal gas flue 6 is illustrated in FIG. 5. Here, the evaporator tube 50, connected to the economizer 28 on the inlet side through the line system 19, enters the containment wall 9 of the combustion chamber 4, so as to be laterally offset by one tube division, above the inlet portion E. What is meant by laterally offset by one tube division is that the entry of the evaporator tube 50 into the containment wall 9 of the combustion chamber 4 takes place at a distance of one tube layer from the connection 36 of the combustion chamber 4 to the horizontal gas flue 6. The routing of the evaporator tube 50 changes through 90° in the immediate vicinity of the inlet header system 18, and the evaporator tube 50 is routed outside the containment wall 9 of the combustion chamber 4 in the direction of the side wall 12 of the horizontal gas flue 6. Before entry into the side wall 12 of the horizontal gas flue 6, the routing of the evaporator tube 50 changes again through 90° in the direction of the outlet header system 22. The evaporator tube 50 is guided vertically in the side wall 12 of the horizontal gas flue 6 at a distance of one tube layer from the connection 36 of the combustion chamber 4 to the horizontal gas flue 6. In the side wall 12 of the horizontal gas flue 6, a change of direction of the evaporator tube 50 in the vertical direction takes place again, laterally offset by one tube layer, below the entry of the evaporator tube 50 into the containment wall 9 of the combustion chamber 4, so that the evaporator tube 50 is directly adjacent to the connection 36 of the combustion chamber 4 to the horizontal gas flue 6. Above the level of entry of the evaporator tube 50 into the containment wall 9 of the combustion chamber 4, a change in the routing of the evaporator tube 50 takes place once again, specifically from the side wall 12 of the horizontal gas flue 6 into the containment wall 9 of the combustion chamber 4. In the containment wall 9 of the combustion chamber 4, the evaporator tube 50 is then guided, in its last portion, vertically along the connection 36 of the combustion chamber 4 to the horizontal gas flue 6 towards the outlet header system 20.

The routing of the evaporator tube 52 in the embodiment matches the routing of the evaporator tube 50. The evaporator tube 52 enters the containment wall 9 of the combustion chamber 4 below the entry of the evaporator tube 50 and is connected to the economizer 28 on the inlet side by the line system 19. The entry of the evaporator tube 52 takes place, in the embodiment, in the tube layer that is adjacent to the connection 36 of the combustion chamber 4 to the horizontal gas flue 6. After the evaporator tube 52 enters the containment wall 9 of the combustion chamber 4, the evaporator tube 52 is guided vertically from the top downward. A change in the routing of the evaporator tube 52 through 90° in the direction of the side wall 12 of the horizontal gas flue 6 takes place in the immediate vicinity of the inlet header system 18. It changes its direction once again through 90°, level with the first tube layer that is adjacent to the connection 36 of the combustion chamber 4 to the horizontal gas flue 6, and enters the side wall 12 of the horizontal gas flue 6. From such a level, the evaporator tube 52 is guided vertically in the side wall 12 of the horizontal gas flue 6. The tube 52, therefore, forms the connecting tube of the side wall 12 of the horizontal gas flue 6 to the containment wall 9 of the combustion chamber 4. The evaporator tube 52 leaves the side wall 12 of the horizontal gas flue 6 above the level of entry of the evaporator tube 52 into the containment wall 9 of the combustion chamber 4 to be guided in the vertical direction above the entry of the evaporator tube 52 in the containment wall 9 of the combustion chamber 4, specifically in vertical alignment with the entry of the evaporator tube 52. Above the entry of the evaporator tube 50 into the containment wall 9 of the combustion chamber 4, the routing of the evaporator tube 52 changes once again, then to be guided vertically in the containment wall 9 of the combustion chamber 4 in vertical alignment with the first portion of the evaporator tube 50. The last portion of the evaporator tube 52 is, therefore, guided in vertical alignment with the first portion of the evaporator tube 50. Both the evaporator tube 50 and the evaporator tube 52 are connected on the inlet side to the line system 19 between the economizer 28 and the inlet header system 18 and on the outlet side to the outlet header system 20.

The steam generator tube 54 is connected on the inlet side to the inlet header system 21. After the steam generator tube 54 emerges from the inlet header system 21, the steam generator tube 54 is guided outside the horizontal gas flue 6. Above the change of the evaporator tube 50 from the side wall 12 of the horizontal gas flue 6 into the containment wall 9 of the combustion chamber 4, the steam generator tube 54 enters the side wall 12 of the horizontal gas flue 6. The last portion of the steam generator tube 54 that is guided in the side wall 12 of the horizontal gas flue 6 is in the embodiment guided along the connection 36 of the combustion chamber 4 to the horizontal gas flue 6. Therefore, the side wall 12 of the horizontal gas flue 6 is formed at the connection 36 by the evaporator tube 50 in the lower part and by the steam generator tube 54 in the upper part.

The steam generator tube 56 is also connected to the inlet header system 21 on the inlet side in FIG. 5.

The steam generator tube 56 is first guided outside the horizontal gas flue 6. The steam generator tube 56 enters the side wall 12 of the horizontal gas flue 6 only above the point at which the evaporator tube 50 has changed its routing from being offset by one tube layer to the connection 36 to a routing that is directly adjacent to the connection 36. The steam generator tubes 54 and 56 are respectively connected to the outlet header system 22 on the outlet side.

By virtue of the special tube routing of the evaporator tubes 50 and 52 and of the steam generator tubes 54 and 56, when the continuous-flow steam generator 3 is in operation, temperature differences at the connection 36 between the combustion chamber 4 and the horizontal gas flue 6 are kept particularly low in a particularly reliable way. The flow medium S, and, therefore, also the evaporator tube 50 or 52, enters the containment wall 9 of the combustion chamber 4 above the entry portion E. The further tube routing of the evaporator tubes 50 and 52 and of the steam generator tubes 54 and 56 then takes place such that, when the continuous-flow steam generator 2 is in operation, the evaporator tubes 50 and 52 and, therefore, also the flow medium S carried therein are preheated by heating, before a direct connection to the steam generator tubes 54, 56 and to a further steam generator tube 16 of the side wall 12 of the horizontal gas flue 6 takes place. As a result, when the continuous-flow steam generator 2 is in operation, the evaporator tubes 50 and 52 have at the connection 36 a comparatively higher temperature than the evaporator tubes 10 of the containment wall 9 of the combustion chamber 4 that are directly adjacent to them.

Figure 6:
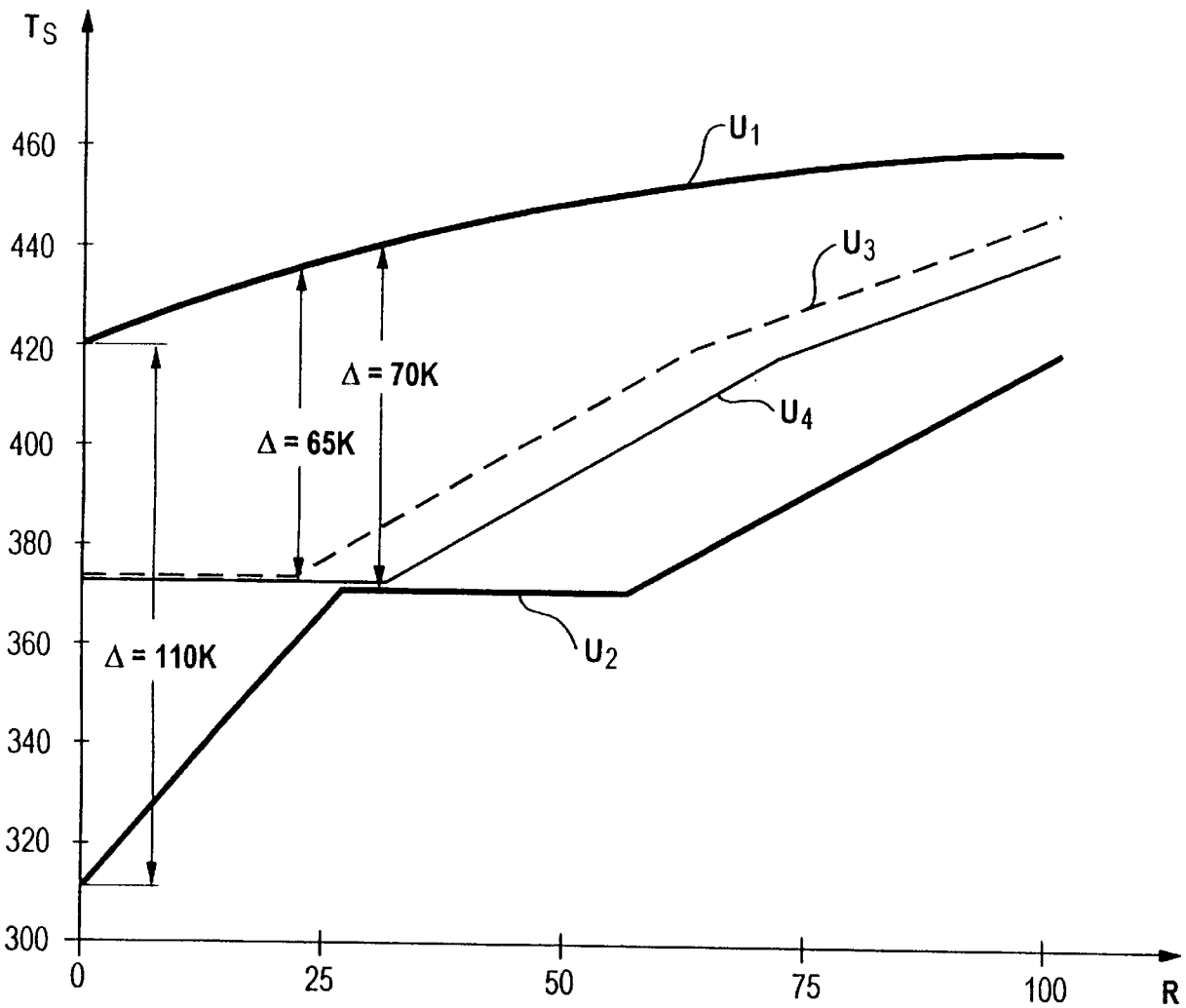
FIG. 6 is a graph illustrating temperatures as a function of a relative tube length of a part of an evaporator tube or steam generator tube according to the invention.

As an example of possible temperatures $T_s$ of the flow medium S in the evaporator tubes 10 of the combustion chamber 4, and in the steam generator tubes 16 of the horizontal gas flue 6, the curves $U_1$ to $U_4$ are plotted, for the exemplary embodiment according to FIG. 5, in the coordinate system according to FIG. 6 for some temperatures $T_s$ (given in ° C.) as a function of the relative tube length R of that part of an evaporator tube 10, 50, 52 or of the steam generator tubes 54, 56 through which the flow passes from the bottom upward (given in %). In such a case, the horizontally routed region, that is to say the steps, is not taken into account in the curves shown. $U_1$ describes, in FIG. 6, the temperature profile of a steam generator tube 16 of the horizontal gas flue 6. In contrast, $U_2$ describes a temperature profile of an evaporator tube 10 along its relative tube length R. $U_3$ describes the temperature profile of that part of the specially routed evaporator tube 50 through which the flow passes from the bottom upward, and $U_4$ describes the temperature profile of that part of the evaporator tube 52 of the containment wall 9 of the combustion chamber 4 through which the flow passes from the bottom upward. It becomes clear from the curves depicted that, due to the special tube routing of the evaporator tubes 50 and 52 in the entry portion E of the evaporator tubes 10 in the containment wall 9 of the combustion chamber 4, the temperature difference from the steam generator tubes 16 of the containment wall 12 of the horizontal gas flue can be markedly reduced. In the example, the temperature of the evaporator tubes 50 and 52 in the entry portion E of the evaporator tubes 50 and 52 can be increased by 45 Kelvin. As a result, when the continuous-flow steam generator 2 is in operation, particularly low temperature differences in the entry portion E of the evaporator tubes 50 and 52 and in the steam generator tubes 16 of the horizontal gas flue 6 at the connection 36 between the combustion chamber 4 and the horizontal gas flue 6 are ensured.

When the continuous-flow steam generator 2 is in operation, fossil fuel B, preferably, coal in solid form, is fed to the burners 30. The flames F of the burners 30 are in the embodiment oriented horizontally. Due to the form of construction of the combustion chamber 4, a flow of the fuel gas G occurring during combustion is generated in the approximately horizontal main direction of flow 24. The flow passes through the horizontal gas flue 6 into the vertical gas flue 8 oriented approximately toward the ground and leaves the vertical gas flue 8 in the direction of the non-illustrated chimney.

Flow medium S entering the economizer 28 passes into the inlet header system 18 of the evaporator tubes 10 of the combustion chamber 4 of the continuous-flow steam generator 2. In the vertically disposed evaporator tubes 10 of the combustion chamber 4 of the continuous-flow steam generator 2 that are gastightly welded to one another, evaporation and, if appropriate, partial superheating of the flow medium S take place. The steam or the water/steam mixture occurring at the same time is collected in the outlet header system 20 for flow medium S. The steam or the water/steam mixture passes from there, through the walls of the horizontal gas flue 6 and of the vertical gas flue 8, into the superheater heating surfaces 23 of the horizontal gas flue 6. In the superheater heating surfaces 23, further superheating of the steam takes place, the latter subsequently being fed for utilization, for example to the drive of a steam turbine.

By the special routing of the evaporator tubes 50 and 52, the temperature differences between the outlet region 34 of the combustion chamber 4 and the inlet region 32 of the horizontal gas flue 6 are particularly low when the continuous-flow steam generator is in operation. At the same time, a choice of the length L of the combustion chamber 4 as a function of the steam power output M of the continuous-flow steam generator 2 under full load ensures that the combustion heat of the fossil fuel B is utilized particularly reliably. Moreover, by virtue of its particularly low overall height and compact form of construction, the continuous-flow steam generator 2 can be set up at a particularly low outlay in terms of production and assembly. In such a case, a framework capable of being erected at a comparatively low technical outlay can be provided. In a power plant with a steam turbine and with a continuous-flow steam generator 2 having such a small overall height, moreover, the connecting pipes from the continuous-flow steam generator to the steam turbine can be made particularly short.

I claim:

1. A continuous-flow steam generator, comprising:

a combustion chamber for combusting fossil fuel, said combustion chamber having a fuel-gas side, an outlet region, burners, and containment walls formed from vertically disposed evaporator tubes welded to one another in a gastight manner;

a horizontal gas flue having an inlet region and being disposed level with respect to said burners of said combustion chamber;

a vertical gas flue connected to said fuel-gas side of said combustion chamber through said horizontal gas flue;

a connecting portion forming said outlet region of said combustion chamber and said inlet region of said horizontal gas flue;

a plurality of said evaporator tubes respectively acted upon in parallel by a flow medium; and a number of said evaporator tubes formed in a loop in said connecting portion.

2. The continuous-flow steam generator according to claim 1, wherein said horizontal gas flue has side walls formed from vertically disposed steam generator tubes welded to one another in a gastight manner and acted upon in parallel by the flow medium.

3. The continuous-flow steam generator according to claim 1, wherein said vertical gas flue has side walls formed from vertically disposed steam generator tubes welded to one another in a gastight manner and acted upon in parallel by the flow medium.

4. The continuous-flow steam generator according to claim 1, wherein:

a plurality of said evaporator tubes are acted upon in parallel by the flow medium;

a common inlet header system precedes said plurality of said evaporator tubes with respect to a direction of the flow medium; and a common outlet header system follows said plurality of said evaporator tubes with respect to the flow medium direction.

5. The continuous-flow steam generator according to claim 1, including:

a common inlet header system;

a common outlet header system; and a number of said steam generator tubes, acted upon in parallel by the flow medium, of one of said horizontal gas flue and said vertical gas flue are preceded in a direction of the flow medium by said common inlet header system and are followed in the flow medium direction by said common outlet header system.

6. The continuous-flow steam generator according to claim 1, wherein:

one containment wall of said combustion chamber is an end wall; and evaporator tubes of said end wall are acted upon in parallel by the flow medium.

7. The continuous-flow steam generator according to claim 6, wherein evaporator tubes of said end wall of said combustion chamber precede other containment walls of said combustion chamber in a direction of the flow-medium.

8. The continuous-flow steam generator according to claim 1, wherein:

a number of said evaporator tubes of said combustion chamber each have an inside tube diameter; and said inside tube diameter is selected as a function of a respective position of each of said number of said evaporator tubes in said combustion chamber.

9. The continuous-flow steam generator according to claim 1, wherein a number of said evaporator tubes have an inside surface and ribs forming a multiflight thread disposed on said inside surface.

10. The continuous-flow steam generator according to claim 9, wherein each of said evaporator tubes has a tube axis;

said ribs have flanks; and a pitch angle between a plane perpendicular to said tube axis and said flanks of said ribs is less than 60°.

11. The continuous-flow steam generator according to claim 9, wherein:

each of said evaporator tubes has a tube axis;

said ribs have flanks; and a pitch angle between a plane perpendicular to said tube axis and said flanks of said ribs is less than 60° and greater than 0°.

12. The continuous-flow steam generator according to claim 9, wherein:

each of said evaporator tubes has a tube axis;

said ribs have flanks; and a pitch angle between a plane perpendicular to said tube axis and said flanks of said ribs is less than 55° and greater than 0°.

13. The continuous-flow steam generator according to claim 1, wherein a number of said evaporator tubes each have a throttle device for controlling flow of the flow medium.

14. The continuous-flow steam generator according to claim 1, including a line system for feeding flow medium into said evaporator tubes of said combustion chamber, said line system having throttle devices for reducing throughflow of the flow medium in said line system.

15. The continuous-flow steam generator according to claim 14, wherein said throttle devices are throttle assemblies.

16. The continuous-flow steam generator according to claim 1, wherein:

said evaporator tubes and said steam generator tubes have fins;

adjacent ones of at least one of said evaporator tubes and said steam generator tubes are welded to one another in a gastight manner by said fins; and each of said fins have a fin width selected as a function of a respective position of a corresponding one of said evaporator tubes and said steam generator tubes in at least one of said combustion chamber, said horizontal gas flue, and said vertical gas flue.

17. The continuous-flow steam generator according to claim 1, including superheater heating surfaces suspended in said horizontal gas flue.

18. The continuous-flow steam generator according to claim 1, including convection heating surfaces disposed in said vertical gas flue.

19. The continuous-flow steam generator according to claim 1, wherein:

said combustion chamber has an end wall; and said burners are disposed on said end wall.

20. The continuous-flow steam generator according to claim 19, wherein:

said combustion chamber has a length defined by a distance between said end wall of said combustion chamber and said inlet region of said horizontal gas flue; and said length is at least equal to a burnup length of the fuel in a full-load mode of the continuous-flow steam generator.

21. The continuous-flow steam generator according to claim 20, wherein said length of said combustion chamber is selected as a function of at least one of:

a steam power output under full load of the continuous-flow steam generator;

a burnup time;

a flame of the fuel; and an outlet temperature of a fuel gas from said combustion chamber approximately according to the following two functions:

$$L\ (M,\ t_A)=(C_1+C_2\cdot M)\cdot t_A;$$

and $$L\ (M,\ T_{BRK})=(C_3\cdot T_{BRK}+C_4)M+C_5(T_{BRK})^2+C_6\cdot T_{BRK}+C_7,$$

where:

$C_1$=8 m/s;

$C_2$=0.0057 m/kg;

$C_3=-1.905\cdot 10^{-4}$(m·s)/(kg° C.);

$C_4$=0.286 (s·m)/kg;

$C_5=3\cdot 10^{-4}$ m/(° C.)$^2$;

$C_6$=−0.842 m/° C.; and $C_7$=603.41 m, a respectively higher value of said length of said combustion chamber being applicable for a predetermined steam power output under full load of the continuous-flow steam generator.

22. The continuous-flow steam generator according to claim 1, wherein said combustion chamber has a length selected as a function of at least one of:

a steam power output under full load of the continuous-flow steam generator;

a burnup time;

a flame of the fuel; and an outlet temperature of a fuel gas from said combustion chamber approximately according to the following two functions:

$$L\ (M,\ t_A)=(C_1+C_2\cdot M)\cdot t_A;$$

and $$L\ (M,\ T_{BRK})=(C_3\cdot T_{BRK}+C_4)M+C_5(T_{BRK})^2+C_6\cdot T_{BRK}+C_7,$$

where:

$C_1$=8 m/s;

$C_2$=0.0057 m/kg;

$C_3=-1.905\cdot 10^{-4}$(m·s)/(kg° C.);

$C_4$=0.286 (s·m)/kg;

$C_5=3\cdot 10^{-4}$ m/(° C.)$^2$;

$C_6$=−0.842 m/° C.; and $C_7$=603.41 m, a respectively higher value of said length of said combustion chamber being applicable for a predetermined steam power output under full load of the continuous-flow steam generator.

23. The continuous-flow steam generator according to claim 1, wherein said combustion chamber has a lower region configured as a funnel.

* * * * *